US009083068B2

(12) United States Patent
Jones

(10) Patent No.: US 9,083,068 B2
(45) Date of Patent: Jul. 14, 2015

(54) ULTRA-WIDEBAND 180 DEGREE HYBRID FOR DUAL-BAND CELLULAR BASESTATION ANTENNA

(71) Applicant: Andrew LLC, Hickory, NC (US)

(72) Inventor: Bevan Beresford Jones, North Epping (AU)

(73) Assignee: CommScope Technologies LLC, Hickory, NC (US)

( * ) Notice: Subject to any disclaimer, the term of this patent is extended or adjusted under 35 U.S.C. 154(b) by 348 days.

(21) Appl. No.: 13/804,522

(22) Filed: Mar. 14, 2013

(65) Prior Publication Data

US 2014/0159977 A1 Jun. 12, 2014

Related U.S. Application Data

(60) Provisional application No. 61/734,469, filed on Dec. 7, 2012.

(51) Int. Cl.

| | |
|---|---|
| ***H01P 5/18*** | (2006.01) |
| ***H01Q 5/00*** | (2015.01) |
| ***H01P 5/22*** | (2006.01) |
| ***H01Q 25/02*** | (2006.01) |
| ***H01Q 1/24*** | (2006.01) |
| ***H01Q 25/00*** | (2006.01) |
| *H01P 5/12* | (2006.01) |

(52) U.S. Cl.

CPC ..... *H01P 5/184* (2013.01); *H01P 5/22* (2013.01); *H01Q 1/246* (2013.01); *H01Q 25/001* (2013.01); *H01Q 25/02* (2013.01); *H01P 5/12* (2013.01)

(58) Field of Classification Search

CPC ..... H01P 5/22; H01P 5/12; H01P 5/184; H01Q 1/246; H01Q 25/001; H01Q 25/02

USPC ..... 333/117

See application file for complete search history.

(56) References Cited

U.S. PATENT DOCUMENTS

| | | | | |
|---|---|---|---|---|
| 6,292,070 | B1 * | 9/2001 | Merrill | 333/26 |
| 7,646,261 | B2 * | 1/2010 | Kirkeby | 333/112 |
| 8,493,162 | B1 * | 7/2013 | Podell | 333/131 |
| 2002/0003455 | A1 * | 1/2002 | Vandersteen et al. | 333/117 |
| 2006/0066418 | A1 * | 3/2006 | Podell | 333/116 |
| 2008/0258838 | A1 * | 10/2008 | Oshima | 333/25 |
| 2009/0284326 | A1 * | 11/2009 | Napijalo | 333/117 |

* cited by examiner

*Primary Examiner* — Stephen E Jones
*Assistant Examiner* — Scott S Outten
(74) *Attorney, Agent, or Firm* — Husch Blackwell LLP

(57) ABSTRACT

Ultra-wideband 180° hybrids for feeding a radiator of one band of a dual-band dual-polarization cellular basestation antenna are disclosed. The hybrid comprises: metal plates configured in parallel as groundplanes, and a dielectric substrate disposed between plates. First and second metallizations are implemented on opposite exterior surfaces of substrate and are shorted together to keep metal tracks at same potential to form conductor. Plates and first and second metallizations form first stripline circuit implementing matched splitter with short-circuit shunt stub Sum input port is provided at one end and two output ports are provided at opposite ends. Branches of matched splitter narrow to provide gap between output tracks. Third metallization is disposed within substrate. First, second and third metallizations form second stripline circuit. Tracks of third metallization comprise quarter-length transformers of different widths. Difference input port is provided at one end of second stripline circuit and at short-circuit point of short-circuit shunt stub of first stripline circuit. Metal track extends across gap of first stripline circuit.

10 Claims, 3 Drawing Sheets

Optimised Hybrid Tracks

| No. | Admittance Y | Impedance Z (ohms) | Length λ | @ freq (GHz) |
|---|---|---|---|---|
| 852 | 1.000 | 50.0 | 0.25 | 0.819 |
| 850 | 1.210 | 41.3 | 0.25 | 0.819 |
| 856 | 1.544 | 32.4 | 0.25 | 0.819 |
| 858,860 | 0.902 | 55.4 | 0.25 | 0.819 |
| 880 | 0.890 | 56.2 | 0.25 | 0.819 |
| 882 | 0.726 | 68.9 | 0.25 | 0.819 |
| 884 | 0.576 | 86.7 | 0.25 | 0.819 |
| 886 | 0.446 | 112.0 | 0.25 | 0.819 |

ULTRA-WIDEBAND 180 DEGREE HYBRID FOR DUAL-BAND CELLULAR BASESTATION ANTENNA

RELATED APPLICATION

This application is a continuation of, and claims priority to U.S. application Ser. No. 61/734,469, the disclosure of which is incorporated by reference.

TECHNICAL FIELD

The present invention relates generally to antennas for cellular systems and in particular to antennas for cellular basestations.

BACKGROUND

Developments in wireless technology typically require wireless operators to deploy new antenna equipment in their networks. Disadvantageously, towers have become cluttered with multiple antennas while installation and maintenance have become more complicated. Basestation antennas typically covered a single narrow band. This has resulted in a plethora of antennas being installed at a site. Local governments have imposed restrictions and made getting approval for new sites difficult due to the visual pollution of so many antennas. Some antenna designs have attempted to combine two bands and extend bandwidth, but still many antennas are required due to the proliferation of many air-interface standards and bands.

Cellular basestation antennas generally radiate dual-slant polarization inclined at +/−45° to vertical. However, in a dual band dual polarization antenna where the radiating elements associated with a low frequency band and a high frequency band must be interspersed, it may be desirable to have the radiators of one band, usually the high frequency band inclined so that those radiators radiate dual slant polarization and the radiators of the second band, usually the low frequency band, arranged to radiate vertical and horizontal polarization. This avoids obstruction of the radiating elements of one band by the radiating elements of the other band.

Although the radiators of one band may be aligned to radiate vertical and horizontal polarization, both bands generally radiate dual-slant polarization. An equal-split 180° hybrid is required to effect this transformation.

An equal-split 180° hybrid coupler or junction (simply "hybrid" hereinafter) is a well-known four-port directional coupler designed for a 3 dB power split (i.e., an equal power split). For example, a rat-race coupler is such a 180° hybrid. The 180° hybrid has two input and two output ports. One input port is typically referred to as the Sum input (designated by sigma, Σ) and the other input is typically referred to as the Difference input (designated by delta, Δ). A signal input to the Σ input port of the 180° hybrid produces the signal split at the output ports both in phase. However, if the signal is input to the Δ input port, the 180° hybrid produces the signal split at the output ports, one in phase and the other 180° out of phase. A rat-race 180° hybrid has four ports, adjacent ports being separated by a section of metal tracks (e.g., microstrip or stripline) or waveguide. Three sections between the four ports (port 1 to port 2, port 2 to port 3, port 3 to port 4) are one quarter wavelength (λ/4) apart. The first and last ports (port 1 to port 4) are separated by a section of three quarters wavelength (3λ/4). Disadvantageously, such a 180° hybrid coupler is narrowband, only giving a correct phase at one frequency.

SUMMARY

The following definitions are provided as general definitions and should in no way limit the scope of the present invention to those terms alone, but are set forth for a better understanding of the following description.

Unless defined otherwise, all technical and scientific terms used herein have the same meaning as commonly understood by those of ordinary skill in the art to which the invention belongs. For the purposes of the present invention, the following terms are defined below:

The articles "a" and "an" are used herein to refer to one or to more than one (i.e. to at least one) of the grammatical object of the article. By way of example, "an element" refers to one element or more than one element.

Throughout this specification, unless the context requires otherwise, the words "comprise", "comprises" and "comprising" will be understood to imply the inclusion of a stated step or element or group of steps or elements, but not the exclusion of any other step or element or group of steps or elements.

In accordance with an aspect of the invention, there is provided a 180° hybrid for feeding a radiator of one band of an ultra-wideband dual-band dual-polarization cellular basestation antenna. The dual bands comprise low and high bands. The 180° hybrid comprises: a substrate of dielectric material, a pair of metal plates configured in parallel as groundplanes, and first, second and third metallizations. The substrate is disposed between the metal plates. The first and second metallizations comprise a number of metal tracks implemented on opposite exterior surfaces of the substrate in a mirrored configuration to directly overlap one another. The first and second metallizations are shorted together to keep the metal tracks at the same potential. The metal plates and the first and second metallizations form a first stripline circuit that implements a matched splitter with an additional short-circuit shunt stub. The metal plates serve as the ground for the first stripline circuit. A sum input port is provided at one end and two output ports are provided at opposite ends. Branches of the matched splitter narrow to provide a gap between output tracks providing the two output ports. The third metallization comprises a number of metal tracks disposed within the substrate disposed between the first and second metallizations to provide a center conductor. The first and second metallizations form the ground and the third metallization forms the active conductor of a second stripline circuit. The metal tracks of the third metallization comprise a number of quarter-length transformers of different widths. A difference input port is provided at one end of the second stripline circuit and at the short-circuit point of the short-circuit shunt stub of the first stripline circuit. A portion of the third metallization in the form of a metal track extends across the gap of the first stripline circuit. A difference signal is applied by the second stripline circuit at the output ports from the input port of the second stripline circuit due to the break in the ground of the second stripline circuit.

The widths of sections of tracks are optimized so that the sum and difference inputs are optimally matched over a desired bandwidth when the output ports are terminated.

The space between the substrate and the metal plates may be filled with air or low density foam, or solid dielectric.

A track of the second stripline circuit follows the centerline of the shunt stub and one branch of the first stripline circuit to the gap.

A terminal track of the second stripline circuit may be U-shaped, crossing the gap of the first stripline circuit, and continuing for approximately a quarter wavelength along the centerline of an opposite branch of the first stripline circuit.

The hybrid may be adapted for the frequency range of 698-960 MHz.

In accordance with a further aspect of the invention, there is provided a radiator for one band of dual band antenna. The radiator comprises horizontal and vertical radiators. A hybrid as set forth in a foregoing aspect may be electrically connected to the radiators to produce the dual-slant polarization.

In accordance with another aspect of the invention, there is provided a low-band radiator of an ultra-wideband dual-band dual-polarization cellular basestation antenna. The dual bands comprise low and high bands. The low-band radiator comprises: a dipole comprising two dipole arms, each dipole arm resonant at approximately a quarter-wavelength ($\lambda/4$), adapted for connection to an antenna feed; an extended dipole with anti-resonant dipole arms, each dipole arm of approximately a half-wavelength ($\lambda/2$), the dipole and extended dipoles being configured in a crossed arrangement; a capacitively coupled feed connected to the extended dipole for coupling the extended dipole to the antenna feed; and a pair of auxiliary radiating elements, configured in parallel at opposite ends of the extended dipole, wherein the dipole and the pair of auxiliary radiating elements together produce a desired narrower beamwidth. A 180° hybrid as set forth in a foregoing aspect is connected to the dipoles to produce the dual-slant polarization.

In accordance with yet another aspect of the invention, there is provided an ultra-wideband cellular dual-polarization dual-band basestation antenna. The dual band has low and high bands suitable for cellular communications. The dual-band antenna comprising: a plurality of low-band radiators as set forth in the foregoing aspect, each adapted for dual polarization and providing clear areas on a groundplane of the dual-band antenna for locating high band radiators in the dual-band antenna; and a plurality of high band radiators each adapted for dual polarization, the high band radiators being configured in at least one array, the low-band radiators being interspersed amongst the high-band radiators at predetermined intervals.

BRIEF DESCRIPTION OF DRAWINGS

Arrangements of 180° hybrids for ultra-wideband dual-band dual-polarization cellular basestation antennas are described hereinafter, by way of an example only, with reference to the accompanying drawings, in which.

DETAILED DESCRIPTION

Figure 1:
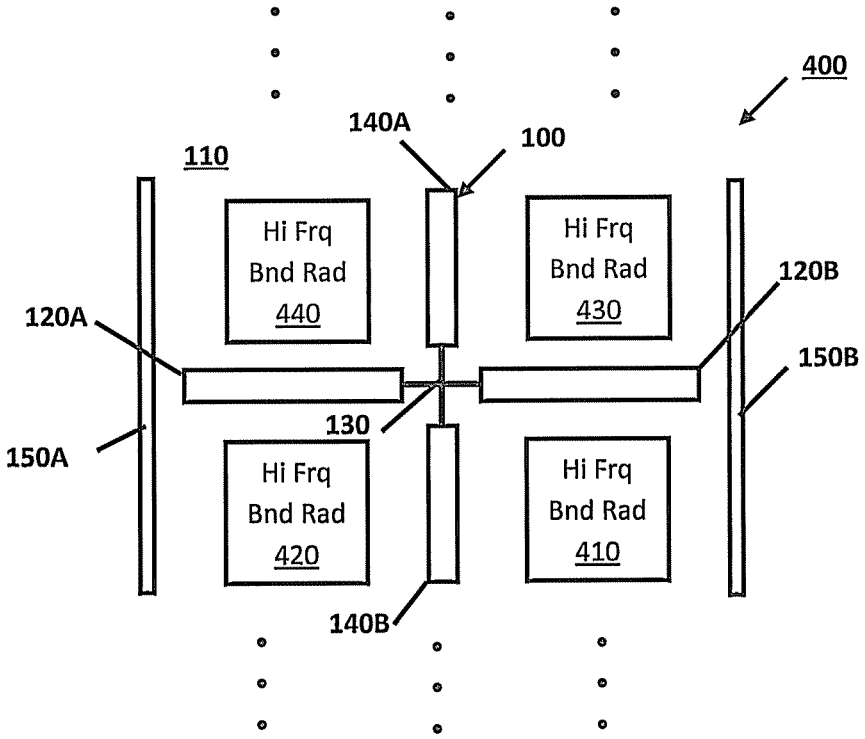
FIG. 1 is a simplified top-plan view of a portion or section of an ultra-wideband, dual-band, dual-polarization cellular basestation antenna.
Figure 2:
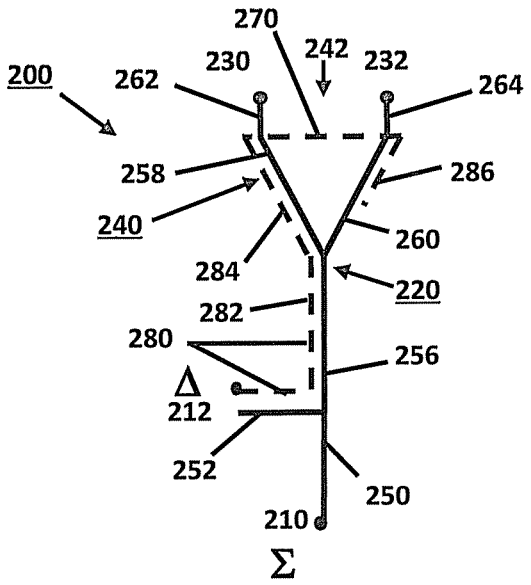
FIG. 2 is a simplified schematic diagram illustrating a 180° hybrid coupler in accordance with an embodiment of the invention.
Figure 3:
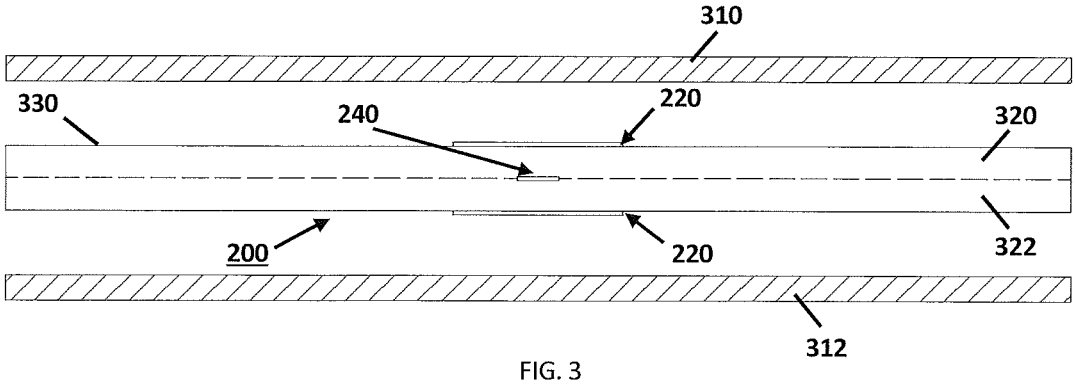
FIG. 3 is a front cross-sectional view showing the two stripline circuits used to realize the 180° hybrid of the type shown in FIG. 2.
Figure 4A:
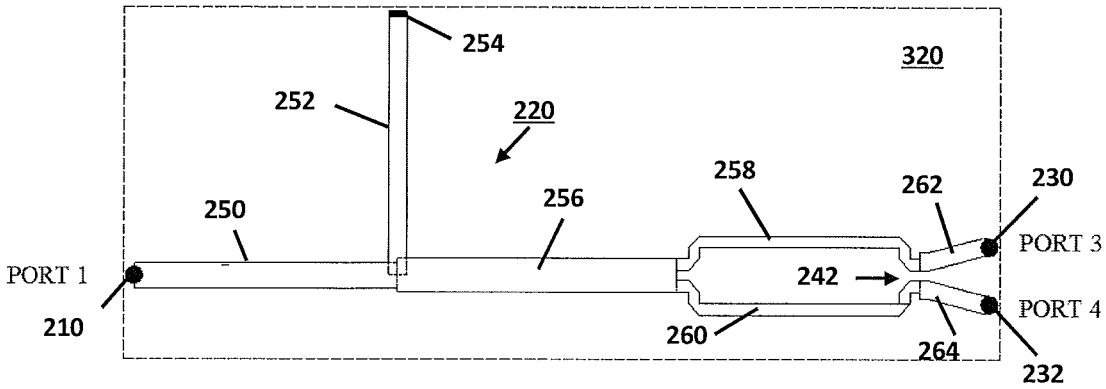
FIG. 4A is a top plan view of the Σ circuit on an outside surface of a substrate.
Figure 4B:
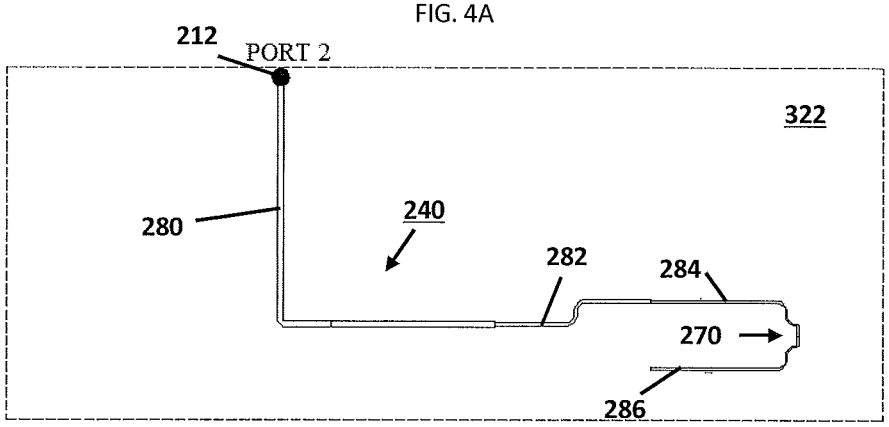
FIG. 4B is a top plan view of the intermediate metal tracks of the second stripline circuit that implements the Δ circuit located on an inside surface of the other substrate.
Figures 5, 6:
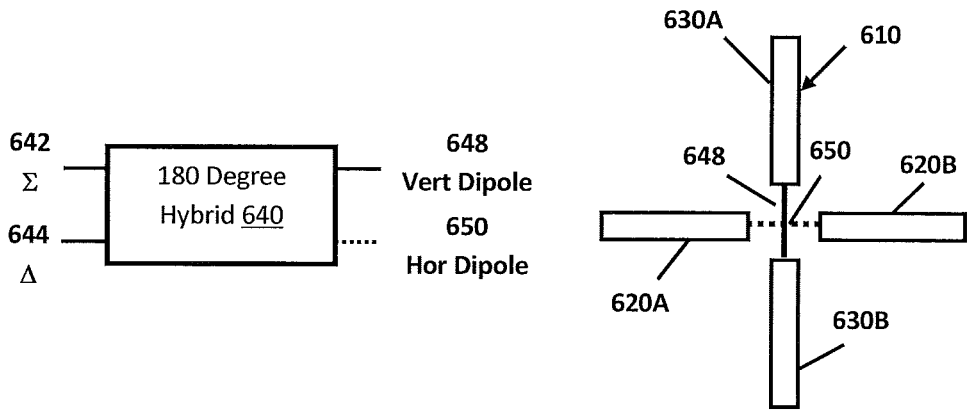
FIG. 5 is a table listing characteristics of optimized hybrid tracks of the implementation shown in FIGS. 2, 3, and 4 for the bandwidth 690-960 MHz.
FIG. 6 is a block diagram illustrating the connection of an ultra-wideband 180° hybrid to horizontal and vertical radiating elements of a radiator for one band.

FIG. 1 is a simplified top-plan view of a portion or section of an ultra-wideband, dual-band, dual-polarization cellular basestation antenna comprising high-band and low-band radiators, where the high-band radiators are configured in one or more arrays, with which a 180° hybrid in accordance with an embodiment may be practiced, for example;

FIG. 2 is a simplified schematic diagram illustrating a 180° hybrid coupler in accordance with an embodiment of the invention comprising two stripline circuits, one within the other, in which overlapping layers of stripline in parallel planes (only one is seen in the drawing), are shorted together and have an intermediate stripline layer (shown with dashed lines and slightly displaced for illustration purposes only) disposed therebetween;

FIG. 3 is a front cross-sectional view showing the two stripline circuits used to realize the 180° hybrid of the type shown in FIG. 2, where the outer plates and the metallized tracks configured in matching patterns on the outer surfaces of the substrate material form a first stripline circuit used to implement the Σ circuit of the 180° hybrid and the matching patterns formed on the outer surface of the substrate together with metallized tracks in the center of the substrate together form a second stripline circuit used to implement the Δ circuit of the 180° hybrid;

FIG. 4A is a top plan view of the Σ circuit on an outside surface of a substrate (a corresponding mirrored pattern is implemented on an outside surface of another substrate that is not shown in FIG. 4) of FIGS. 2 and 3, where corresponding points of the metallization on the upper and lower surfaces of the substrate are maintained at the same potential using connecting pins at occasional intervals along the stripline;

FIG. 4B is a top plan view of the intermediate metal tracks of the second stripline circuit that implements the Δ circuit located on an inside surface of the other substrate, where the two substrates are bonded or fastened together, the Δ circuit is an intermediate track between two overlapping metallized patterns which together with the outer plates, form the Σ circuit;

FIG. 5 is a table listing characteristics of optimized hybrid tracks of the implementation shown in FIGS. 2, 3, and 4 for the bandwidth 690-960 MHz; and FIG. 6 is a block diagram illustrating the connection of an ultra-wideband 180° hybrid to horizontal and vertical radiating elements of a radiator for one band.

Hereinafter, 180° hybrids for ultra-wideband dual-band dual-polarization cellular basestation antennas are disclosed. Again, the term "180° hybrid" is used hereinafter for ease of reference only, and is the equivalent of "180° hybrid coupler" or "180° hybrid junction". In the following description, numerous specific details, including particular horizontal beamwidths, air-interface standards, dipole arm shapes and materials, microstrip or stripline topologies, and the like are set forth. However, from this disclosure, it will be apparent to those skilled in the art that modifications and/or substitutions may be made without departing from the scope and spirit of the invention. In other circumstances, certain details may be omitted so as not to obscure the invention.

As used hereinafter, "low band" refers to a lower frequency band, such as 698-960 MHz, and "high band" refers to a higher frequency band, such as 1710 MHz-2690 MHz. A "low band radiator" refers to a radiator for such a lower frequency band, and a "high band radiator" refers to a radiator for such a higher frequency band. The "dual band" comprises the low and high bands referred to throughout this disclosure. As used hereinafter, the term "metallization" refers to a patterned metal layer comprising one or more conducting metal tracks or strips well known to those skilled in the art.

The embodiments of the invention relate to 180° hybrids for ultra-wideband dual-band dual-polarization antennas adapted to support emerging network technologies. Such ultra-wideband dual-band dual-polarization antennas enable operators of cellular systems ("wireless operators") to use a single type of antenna covering a large number of bands, where multiple antennas were previously required. Such antennas are capable of supporting several major air-interface standards in almost all the assigned cellular frequency bands and allow wireless operators to reduce the number of antennas in their networks, lowering tower leasing costs while increasing speed to market capability.

In the following description, "ultra-wideband" with reference to an antenna connotes that the antenna is capable of operating and maintaining its desired characteristics over a bandwidth of at least 30%. Characteristics of particular interest are the beam width and shape and the return loss, which needs to be maintained at a level of at least 15 dB across this band. In the present instance, the ultra-wideband dual-band antenna covers the bands 698-960 MHz and 1710 MHz-2690 MHz. This covers almost the entire bandwidth assigned for all major cellular systems.

Ultra-wideband dual-band dual-polarization cellular basestation antennas support multiple frequency bands and technology standards. For example, wireless operators can deploy using a single antenna Long Term Evolution (LTE) network for wireless communications in 2.6 GHz and 700 MHz, while supporting Wideband Code Division Multiple Access (W-CDMA) network in 2.1 GHz. For ease of description, the antenna array is considered to be aligned vertically.

FIG. 1 shows the components of a single band of a dual band antenna where the radiating elements are oriented to produce vertical and horizontal polarization; a set of 180° hybrids is used to transform the polarization so that the antenna inputs radiate or receive dual slant polarization. Specifically, FIG. 1 illustrates a portion or section 400 of an ultra-wideband, dual-band dual-polarization cellular basestation antenna comprising four high radiators 410, 420, 430, 440 arranged in a 2×2 matrix with a low-band radiator 100. A single low-band radiator 100 is interspersed at predetermined intervals with these four high band radiators 410, 420, 430, 440.

FIG. 1 illustrates a low-band radiator 100 of an ultra-wideband dual-band cellular basestation antenna 400. Such a low band radiator 100 comprises horizontal dipole 120 and a vertical dipole 140. In this particular embodiment of a dual band antenna, the vertical dipole is a conventional dipole 140 and the horizontal dipole 120 is an extended dipole configured in a crossed-dipole arrangement with crossed center feed 130. Center feed 130 comprises two interlocked, crossed printed circuit boards (PCB) having feeds formed on respective PCBs for dipoles 120, 140. The antenna feed may be a balun, of a configuration well known to those skilled in the art.

The center feed 130 suspends the extended dipole 120 above a metal groundplane 110, by preferably a quarter wavelength above the groundplane 110. A pair of auxiliary radiating elements 150A and 150B, such as tuned parasitic elements or dipoles, or driven dipoles, is located in parallel with the conventional dipole 140 at opposite ends of the extended dipole 120. The tuned parasitic elements may each be a dipole formed on a PCB with metallization formed on the PCB, an inductive element formed between arms of that dipole on the PCB. An inductive element may be formed between the metal arms of the parasitic dipoles 150A, 150B to adjust the phase of the currents in the dipole arms to bring these currents into the optimum relationship to the current in the driven dipole 140. Alternatively, the auxiliary radiating elements may comprise driven dipole elements. The dipole 140 and the pair of auxiliary radiating elements 150 together produce a desired narrower beamwidth.

The dipole 140 is a vertical dipole with dipole arms 140A, 140B that are approximately a quarter wavelength (λ/4), and the extended dipole 120 is a horizontal dipole with dipole aims 120A, 120B that are approximately a half wavelength (λ/2) each. The auxiliary radiating elements 150A and 150B, together with the dipole 140, modify or narrow the horizontal beamwidth in vertical polarization.

The antenna architecture depicted in FIG. 1 includes the low band radiator 100 of an ultra-wideband dual-band cellular basestation antenna having crossed dipoles 120, 140 oriented in the vertical and horizontal directions located at a height of about a quarter wavelength above the metal groundplane 110. This antenna architecture provides a horizontally polarized, desired or predetermined horizontal beamwidth and a wideband match over the band of interest. The pair of laterally displaced auxiliary radiating elements (e.g., parasitic dipoles) 150A, 150B together with the vertically oriented driven dipole 140 provides a similar horizontal beamwidth in vertical polarization. The low-band radiator may be used as a component in a dual-band antenna with an operating bandwidth greater than 30% and a horizontal beamwidth in the range 55° to 75°. Still further, the horizontal beamwidths of the two orthogonal polarizations may be in the range of 55 degrees to 75 degrees. Preferably, the horizontal beamwidths of the two orthogonal polarizations may be in the range of 60 degrees to 70 degrees. Most preferably, the horizontal beamwidths of the two orthogonal polarizations are approximately 65 degrees.

The dipole 120 has anti-resonant dipole arms 120A, 120B of length of approximately λ/2 with a capacitively coupled feed with an 18 dB impedance bandwidth >32% and providing a beamwidth of approximately 65 degrees. This is one component of a dual polarized element in a dual polar wideband antenna, The single halfwave dipole 140 with the two parallel auxiliary radiating elements 150A, 150B provides the orthogonal polarization to signal radiated by extended dipole 120. The low-band radiator 100 of the ultra-wideband dual-band cellular basestation antenna is well suited for use in the 698-960 MHz cellular band. A particular advantage of this configuration is that this low band radiator 100 leaves unobstructed regions or clear areas of the groundplane where the high-band radiators of the ultra-wideband dual-band antenna can be located with minimum interaction between the low band and high band radiators.

The low-band radiators 100 of the antenna 400 as described radiate vertical and horizontal polarizations. For cellular basestation antennas, dual slant polarizations (linear polarizations inclined at +45° and −45° to vertical) are conventionally used. This can be accomplished by feeding the vertical and horizontal dipoles of the low-band radiator from a wideband 180° hybrid (i.e., an equal-split coupler) well known to those skilled in the art.

The crossed-dipoles 120 and 140 define four quadrants, where the high-band radiators 420 and 410 are located in the lower-left and lower-right quadrants, and the high-band radiators 440 and 430 are located in the upper-left and upper-right quadrants. The low-band radiator 100 is adapted for dual polarization and provides clear areas on a groundplane 110 of the dual-band antenna 400 for locating the high band radiators 410, 420, 430, 440 in the dual-band antenna 400. Ellipsis points indicate that a basestation antenna may be formed by repeating portions 400 shown in FIG. 1. The wideband high-band radiators 440, 420 to the left of the centerline comprise one high band array and those high-band radiators 430, 410 to the right of the centerline defined by dipole arm s 140A and 140B comprise a second high band array. Together the two arrays can be used to provide MIMO capability in the high band. Each high-band radiator 410, 420, 430, 440 may be adapted to provide a beamwidth of approximately 65 degrees.

For example, each high-band radiator 410, 420, 430, 440 may comprise a pair of crossed dipoles each located in a square metal enclosure. In this case the crossed dipoles are inclined at 45° so as to radiate slant polarization. The dipoles may be implemented as bow-tie dipoles or other wideband dipoles. While specific configurations of dipoles are shown, other dipoles may be implemented using tubes or cylinders or as metallized tracks on a printed circuit board, for example.

In one example, while the low-band radiator (crossed dipoles with auxiliary radiating elements) 100 may be used for the 698-960 MHz band, and the high-band radiators 410, 420, 430, 440 may be used for the 1.7 GHz to 2.7 GHz (1710-2690 MHz) band. The low-band radiator 100 provides a 65 degree beamwidth with dual polarization (horizontal and vertical polarizations). Such dual polarization is often required for basestation antennas. The conventional dipole 140 is connected to an antenna feed, while the extended dipole 120 is coupled to the antenna feed by a series inductor and capacitor. The low-band auxiliary radiating elements (e.g., parasitic dipoles) 150 and the vertical dipole 140 make the horizontal beamwidth of the vertical dipole 140 together with the auxiliary radiating elements 150 the same as that of the horizontal dipole 120. The antenna 400 implements a multi-band antenna in a single antenna. Beamwidths of approximately 65 degrees are preferred, but may be in the range of 60 degrees to 70 degrees on a single degree basis (e.g., 60, 61, or 62 degrees). This ultra-wideband, dual-band cellular basestation antenna can be implemented in a limited physical space.

As noted hereinbefore, to minimize interaction between low and high band radiators in a dual-polarization, dual-band cellular basestation antenna, the low band radiators are desirably in the form of vertical and horizontal radiating components to leave an unobstructed space for placing the high band radiators. To radiate dual-slant linear polarization using radiator components that radiate horizontal and vertical polarizations, an ultra-wideband 180° hybrid is used to feed the horizontal and vertical components of a radiator of one band of an ultra-wideband dual-band dual-polarization cellular basestation antenna, e.g., the low band.

FIG. 2 illustrates a design for a wideband 180° hybrid 200 useful for combining vertical and horizontal polarization components to form +/−45° polarizations. For ease of illustration only, microwave substrates 320, 322, forming bonded assembly 330 and parallel metal plates 310, 312 to provide groundplanes are illustrated in FIG. 3, and are omitted in FIG. 2. The hidden line 240 (indicated by dashed lines) may be a two- or three-stage transformer to a desired port impedance, e.g. 50 ohms. More particularly, the wideband 180° hybrid 200 of FIG. 2 may be implemented, for example, using two layers of 1.6 mm microwave substrate and foam and metallized plates. FIGS. 3, 4A, and 4B provide further details of actual implementation of the wideband 180° hybrid 200. FIG. 2 is a simplified depiction of what is shown in detail in FIGS. 4A and 4B. The same reference numbers are used in FIGS. 2, 3, 4A, 4B and 5 for the same features/components.

The metal plates 310, 312 (FIG. 3) are configured in parallel as groundplanes, and the bonded assembly 330 is disposed between the metal plates 310, 312. First and second metallizations 220 comprising a number of metal tracks are implemented on opposite exterior surfaces of the bonded assembly 330 in a mirrored configuration to directly overlap one another. The first and second metallizations 220 are shorted together to keep the metal tracks at the same potential and form a single conductor. The metal plates 310, 312 and the first and second metallizations 220 form a first stripline circuit that implements a matched splitter with a short-circuit shunt stub 252. The metal plates 310, 312 are groundplanes for the first stripline circuit. A sum input port 210 is provided at one end and two output ports 230, 232 are provided at the opposite end. Branches of the matched splitter narrow to provide a gap 242 between output tracks 262, 264 providing the two output ports 230, 232. A third metallization 240 comprises a number of metal tracks disposed within the bonded assembly 330 intermediate the first and second metallizations 220 to provide a center conductor. The first, second and third metallizations 220, 240 form a second stripline circuit. The third metallization 240 comprises a number of quarter-length transformers of different widths. A difference input port 212 is provided at one end of the second stripline circuit. A portion of metal track 270 extends across the gap 242 of the first stripline circuit. A difference signal is provided by the second stripline circuit at the output ports 230, 232 from the input of the second stripline circuit due to the break 242 in the ground of the second stripline circuit.

As shown greater detail in FIGS. 3, 4A and 4B, the wideband 180° hybrid 200 for the band radiator comprises a bonded assembly 330 of two microwave substrates 320 and 322. The assembly 330 is centrally located between two parallel metal plates 310 and 312 in FIG. 3. Essentially identical metallizations 220 on the outside or exterior surfaces of the bonded assembly 330 are connected together as required to keep the metal tracks 250, 252, 256, 258, 260, 262, and 264 at the same potential and form a stripline circuit in FIG. 4A with respect to the metal plates 310, 312, which are also connected together so that the metal plates 310, 312 form a ground. The space between the bonded assembly 330 and the plates 310, 312 may be filled with air or low density foam (see FIG. 3). Alternatively, the space between the plates 310, 312 may be filled with a different solid dielectric material. The intermediate metallization 240 and the two parallel metallizations 220 form a second stripline circuit. The intermediate metallization 240 comprises metallized tracks 280, 282, 284, and 286 on one of the inner surfaces of the bonded substrates 320, 322. The second stripline circuit is formed from tracks 280, 282, 284, and 286 of the intermediate metallization 240 and the tracks 250, 252, 256, 258, 260, 262, and 264 of metallizations 220, which form the local ground planes. The dielectric material for the second stripline circuit 220/240 is the microwave substrate 320, 322.

The metallizations 220 implement a conventional matched splitter with the addition of a short-circuit shunt stub 252, 254 of length approximately a quarter wavelength ($\lambda/4$). Exciting input 210 (PORT 1) connected to track 250 causes equal, in-phase excitations of the outputs 230, 232 (PORTS 3 and 4). The short-circuit shunt stub 252, 254 is perpendicular to the length of track 250. Both tracks 250, 252 are connected to track 256. The tracks 258, 260 branch out and separate from the track 256, but at the opposite end narrow together. The output tracks 262, 2864 coupled to tracks 258, 260, respectively, are brought close together to form a gap 242, which is where a difference signal is applied by means of the second stripline circuit 220/240. The outputs 230, 232 (PORTS 3 and 4) are provided at the ends of tracks 262, 264, respectively. In FIG. 4A, only one metallization 220 is shown on a surface of a substrate 220. However, a corresponding matching metallization 220 (not shown) in FIG. 10B is provided on the opposite surface of substrate 222.

The second stripline circuit 220/240 is excited at the short-circuit stub 252, 254 by applying a signal between the central metallization 240 and the tracks 252 of the metallizations 220 which are grounded to the metal plates 310, 312 at this location. Thus, the signal is provided to input 212 (PORT 2) in FIG. 4B. The track 280 of the metallization 240 follows the centerline of the stub 252 and then one branch 256 of the metallization 220 to the gap 242. Narrower track 282 extends from L-shaped track 280 of the metallization 240. The final U-shaped stage of the intermediate metallization 240 comprises tracks 284, 286, which has a protruding section 270 at the base of the U-shape, which crosses the gap 242. The track 284, 286 crosses the gap 242 and continues on for approximately a quarter wavelength along the centerline of the opposite branch 260 of stripline 220.

The ground conductors of the second stripline circuit 220/240 are interrupted as the center conductor 270 crosses the gap 242. This applies the difference signal to the two outputs 230 and 232 (PORTS 3 and 4) so that the outputs have equal out-of-phase excitations. The intermediate metallization 240 has quarterwave transformer sections 280, 282, 284/286 of different widths as shown in FIG. 4B.

The impedances and lengths of the sections of tracks indicated are refined using a circuit optimization program. The optimization criterion used is that the sum of the squares of the reflection coefficients of inputs 210 and 212 is minimized. The impedances of line sections indicated in FIG. 4 and their lengths are allowed to vary to achieve the optimum over the required bandwidth.

The optimum impedances and lengths of the sections 252, 250, 256, 258, 260, 280, 282, 284, and 286 obtained for the 698 MHz to 960 MHz bandwidth are listed in FIG. 5. The wideband 180° hybrid 200 is used produce 45° slant polarization using the horizontal and vertical radiating elements of a radiator for one band, e.g., the dipoles 120, 140 of low band radiator 100. Port 1 (210) produces equal amplitude, in-phase outputs at ports 3 and 4 (230, 232). Port 2 (212) produces equal amplitude, out of phase (180°) outputs at ports 3 and 4 (230, 232). Port 1 (210) is isolated from port 2 (212), and ports 3 and 4 (230, 232) are isolated from each other.

FIG. 6 illustrates the connection of an ultra-wideband 180° hybrid 640, of the type 200 shown in FIGS. 2 to 4, to a radiator 610, e.g. a low-band radiator. The 180° hybrid 640 has inputs 642 and 644 (Σ and Δ) and feeds from outputs 648 and 650 the vertical and horizontal dipoles 630 and 620, respectively, of the radiator 610 of one band of an ultra-wideband dual-band dual-polarization cellular basestation antenna, e.g., the low band, to radiate dual-slant linear polarization using radiator elements 620, 630 that radiate horizontal and vertical polarizations. Each corresponding element of an array can be similarly fed. Inputs to the Σ and Δ inputs radiate +45° and −45° slant polarization, respectively.

The theoretical performance of the wideband 180° hybrid 200 has return loss at each port, isolation between inputs, and isolation between outputs in excess of 40 dB across the 698-960 MHz band. In measurements on a model of the 180° hybrid 200, these values were in excess of 25 dB, and the phases of the outputs were within 2 degrees of nominal.

Thus, wideband 180° hybrids for ultra-wideband dual-band dual-polarization cellular basestation antennas described herein and/or shown in the drawings are presented by way of example only and are not limiting as to the scope of the invention. Unless otherwise specifically stated, individual aspects and components of the hybrids may be modified, or may have been substituted therefore known equivalents, or as yet unknown substitutes such as may be developed in the future or such as may be found to be acceptable substitutes in the future.

What is claimed is:

1. A 180° hybrid for feeding at least one dual-polarization radiator of a wideband dual-polarization cellular basestation antenna, said 180° hybrid comprising:

a substrate of dielectric material;

a pair of metal plates configured in parallel as ground-planes, said substrate disposed between said pair of metal plates;

first and second metallizations comprising a plurality of metal tracks implemented on opposite exterior surfaces of said substrate in a mirrored configuration to directly overlap one another, said first and second metallizations being shorted together to keep the metal tracks at the same potential to form a conductor, said metal plates and said first and second metallizations forming a first stripline circuit that implements a matched splitter with a short-circuit shunt stub, said metal plates being grounded for said first stripline circuit, a sum input port provided at one end and two output ports provided at opposite ends, wherein branches of said matched splitter narrow to provide a gap between output tracks providing said two output ports;

a third metallization comprising a plurality of metal tracks disposed within said substrate disposed between said first and second metallizations to provide a center conductor, said first, second and third metallizations forming a second stripline circuit, said metal of tracks of said third metallization comprising a plurality of quarter-length transformers of different widths, a difference input port provided at one end of said second stripline circuit and at a short-circuit point of said short-circuit shunt stub of said first stripline circuit, a portion of metal track extending across the gap of said first stripline circuit, wherein a difference signal is applied by said second stripline circuit at said output ports from the input port of said second stripline circuit due to the break in the ground of the second stripline circuit.

2. A low-band radiator of an ultra-wideband dual-band dual-polarization cellular basestation antenna, said dual bands comprising low and high bands, said low-band radiator comprising:

a dipole comprising two dipole arms, each dipole arm resonant at approximately a quarter-wavelength (λ/4), adapted for connection to an antenna feed;

an extended dipole with anti-resonant dipole arms, each dipole arm of approximately a half-wavelength (λ/2), said dipole and extended dipoles being configured in a crossed arrangement;

a capacitively coupled feed connected to said extended dipole for coupling said extended dipole to said antenna feed; and a pair of auxiliary radiating elements, configured in parallel at opposite ends of said extended dipole, wherein said dipole and said pair of auxiliary radiating elements together produce a desired narrower beamwidth than the dipole alone; and a 180° hybrid as claimed in claim 1 connected to said dipoles to produce a dual-slant polarization.

3. An ultra-wideband cellular dual-polarization dual-band basestation antenna, said dual band having low and high bands suitable for cellular communications, said dual-band antenna comprising:

a plurality of low-band radiators as claimed in claim 2, each adapted for dual polarization and providing clear areas on a groundplane of said dual-band antenna for locating high band radiators in said dual-band antenna; and a plurality of high band radiators each adapted for dual polarization, said high band radiators being configured in at least one array, said low-band radiators being interspersed amongst said high-band radiators at predetermined intervals.

4. The hybrid as claimed in claim 1, wherein the widths of sections of tracks are optimized so that the sum and difference inputs are optimally matched over a desired bandwidth.

5. The hybrid as claimed in claim 1, wherein a space between the substrate and each of the pair of metal plates is filled with one of air and low density foam.

6. The hybrid as claimed in claim 1, wherein a space between the substrate and each of the pair of metal plates is filled with solid dielectric.

7. The hybrid as claimed in claim 1, wherein a track of said second stripline circuit follows the centerline of the shunt stub and one branch of said first stripline circuit to said gap.

8. The hybrid as claimed in claim 1, wherein a terminal track of said second stripline circuit is U-shaped, crossing the gap of said first stripline circuit, and continuing for approximately a quarter wavelength along the centerline of an opposite branch of said first stripline circuit.

9. The hybrid as claimed in claim 1, wherein the hybrid is adapted for the frequency range of 698-960 MHz.

10. A radiator for one band of dual band antenna, said radiator comprising:

horizontal and vertical radiators; and a hybrid as claimed in claim 1 electrically connected to said radiators to produce a dual-slant polarization.

* * * * *